US010137697B2

(12) United States Patent
Onishi et al.

(10) Patent No.: US 10,137,697 B2
(45) Date of Patent: Nov. 27, 2018

(54) LIQUID SUPPLY DEVICE, LIQUID EJECTION DEVICE, AND CONTROL METHOD FOR PUMP

(71) Applicant: SEIKO EPSON CORPORATION, Tokyo (JP)

(72) Inventors: Yasunori Onishi, Shiojiri (JP); Takashi Ozawa, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/626,462

(22) Filed: Jun. 19, 2017

(65) Prior Publication Data

US 2018/0001654 A1 Jan. 4, 2018

(30) Foreign Application Priority Data

Jun. 30, 2016 (JP) ..... 2016-129705

(51) Int. Cl.
*B41J 2/175* (2006.01)
*B41J 2/165* (2006.01)

(52) U.S. Cl.
CPC ..... *B41J 2/17596* (2013.01); *B41J 2/175* (2013.01); *B41J 2/16579* (2013.01)

(58) Field of Classification Search
CPC ..... B41J 2/165; B41J 2/175; B41J 2/17596; B41J 2/17566; B41J 2/1404
See application file for complete search history.

(56) References Cited

U.S. PATENT DOCUMENTS

| | | | |
|---|---|---|---|
| 5,098,380 A | 3/1992 | Aizawa et al. | |
| 9,352,574 B2 | 5/2016 | Gomi et al. | |
| 2014/0240406 A1* | 8/2014 | LaCaze | B41J 2/175 347/85 |

FOREIGN PATENT DOCUMENTS

| | | |
|---|---|---|
| JP | H01-249064 A | 10/1989 |
| JP | H02-140174 A | 5/1990 |
| JP | 2008-289635 A | 12/2008 |
| JP | 2015-200289 A | 11/2015 |

* cited by examiner

*Primary Examiner* — Thinh H Nguyen
(74) *Attorney, Agent, or Firm* — Oliff PLC

(57) ABSTRACT

A liquid supply device includes: a force sensor which outputs an output value corresponding to a force of expansion of a detection target site of a blockage detection tube communicating with a liquid election unit for ejecting a liquid; a pump for sending out a liquid in the blockage detection tube toward the liquid ejection unit; and a control unit which stops an operation of the pump when the output value reaches a threshold. The control unit decides the threshold, using, as a reference value, the output value acquired when a predetermined condition is satisfied including that the detection target site is filled with the liquid and that the pump is stopped.

7 Claims, 15 Drawing Sheets

LIQUID SUPPLY DEVICE, LIQUID EJECTION DEVICE, AND CONTROL METHOD FOR PUMP

BACKGROUND

1. Technical Field

The present invention relates to the detection of a blockage in liquid supply.

2. Related Art

JP-A-2008-289635 discloses an infusion device. This infusion device has the function of detecting a blockage in a liquid channel of an infusion tube mechanism, using a sensor (strain gauge mechanism) for detecting a blockage. JP-A-2002-289635 discloses a technique in which variations at the time of manufacturing the infusion tube and variations in the loading state of the infusion tube in an infusion pump mechanism are calibrated for the purpose of detecting a blockage relatively accurately.

The related-art technique does not take the calibration of the sensor itself into consideration at all. Particularly in the case where the sensor has a large individual difference, the accuracy of blockage detection drops if the calibration of the sensor is not considered.

SUMMARY

An advantage of some aspects of the invention is that the sensor for detecting a blockage is properly calibrated.

The invention can be implemented as the following configurations.

An aspect of the invention is directed to a liquid supply device including: a force sensor which outputs an output value corresponding to a force of expansion of a detection target site of a blockage detection tube communicating with a liquid ejection unit for ejecting a liquid; a pump for sending out a liquid in the blockage detection tube toward the liquid ejection unit; and a control unit which stops an operation of the pump if the output value reaches a threshold. The control unit decides the threshold, using, as a reference value, the output value acquired in the case where a predetermined condition is satisfied including that the detection target site is filled with the liquid and that the pump is stopped.

According to this aspect, the threshold can be decided after the force sensor is properly calibrated by using an output value that can be regarded as a zero point in blockage detection, as a reference value.

In the aspect, the liquid ejection unit may include a liquid chamber arranged downstream from the blockage detection tube. The control unit may acquire the reference value if a second condition is satisfied including that the liquid chamber is filled with a liquid, in addition to the predetermined condition. According to the aspect with this configuration, calibration with a more appropriate reference value can be carried out.

In the aspect, the liquid ejection unit may include an election tube for ejecting a liquid passed through the liquid chamber. The control unit may acquire the reference value if the liquid has reached a distal end of the ejection tube, in addition to the second condition. According to the aspect with this configuration, calibration with a more appropriate reference value can be carried out.

In the aspect, the control unit may be configured to control driving of a piezoelectric element which changes a capacity of the liquid chamber and may drive the piezoelectric element if the liquid chamber is filled with a liquid, as a part of initial setting processing. According to the aspect with this configuration, air bubbles in the liquid chamber can be reduced in the initial setting processing.

In the aspect, the control unit may drive the pump for a predetermined period in order to fill the detection target site with a liquid, before acquiring the reference value. According to the aspect with this configuration, the detection target site can be filled with a liquid by simple procedures.

The invention can be implemented in various configurations other than those described above. For example, the invention can be implemented as a liquid ejection device including a blockade detection device as described above, or as a method for deciding the threshold.

BRIEF DESCRIPTION OF THE DRAWINGS

The invention will be described with reference to the accompanying drawings, where like numbers reference like elements.

DESCRIPTION OF EXEMPLARY EMBODIMENTS

Figure 1:
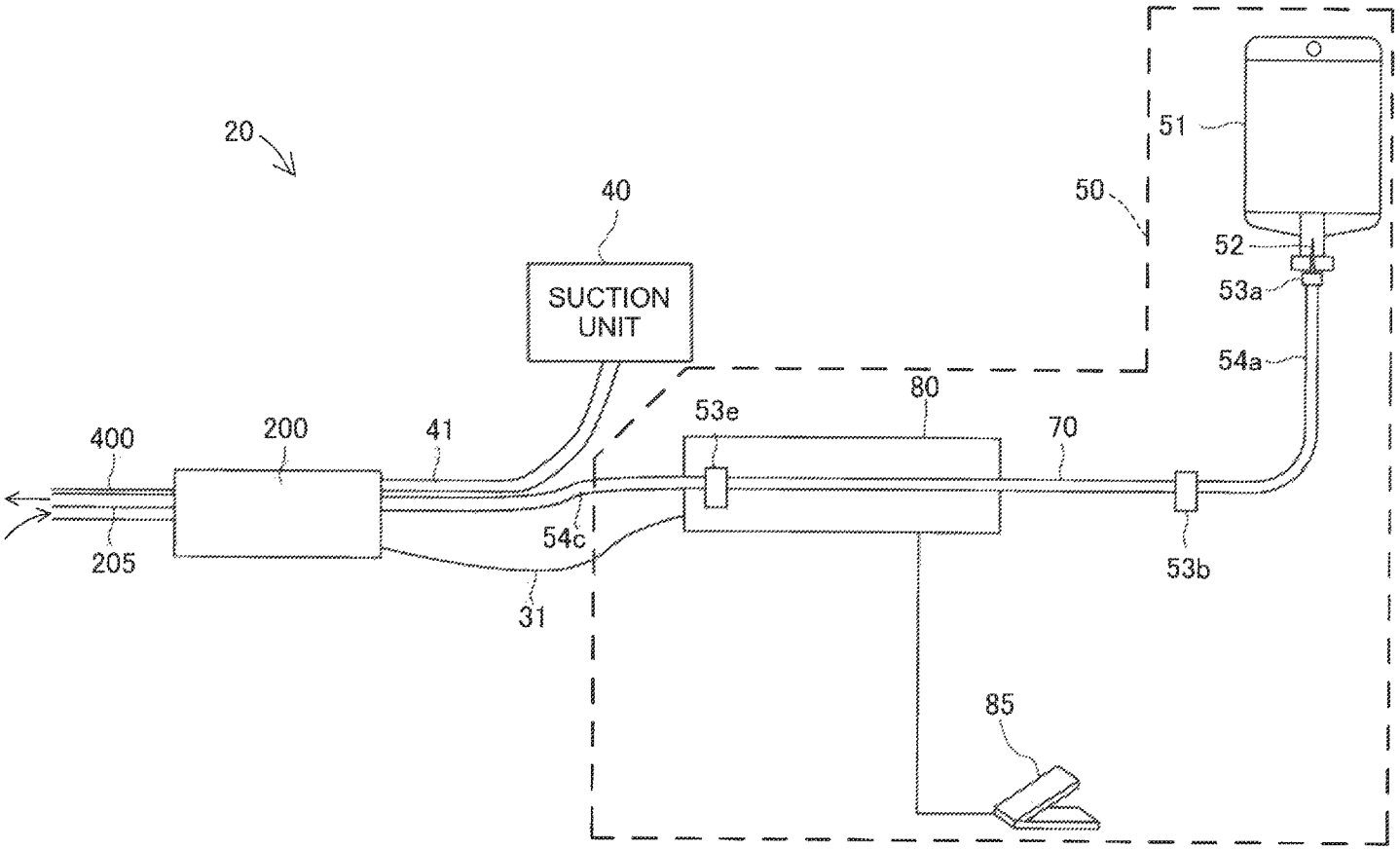
FIG. 1 shows a schematic configuration of a surgical device.

FIG. 1 schematically shows the configuration of a surgical device 20. The surgical device 20 is a medical apparatus for realizing a surgical operation using a liquid. The surgical device 20 has the function of excising an affected part (living tissues) by ejecting a liquid to the affected part, and the function of sucking the ejected liquid and the excised living tissues. Therefore, the surgical device 20 is a liquid election device and a suction device.

The surgical device 20 has an actuator cable 31, a suction unit 40 a suction tube 41, a liquid supply system 50, and a surgical handpiece 200 (hereinafter referred to as the handpiece 200).

The liquid supply system 50 includes a water supply bag 51, a spike 52, a first connector 53*a*, a fifth connector 53*e*, a first water supply tube 54*a*, a third water supply tube 54*c*, a pump tube 55 (described later with reference to FIG. 8 or the like), a subassembly 70, a control device 80, and a foot switch 85. The handpiece 200 includes an ejection tube 209 and a suction tube 400.

The water supply bag 51 is made of a transparent synthetic resin and filled with a liquid (specifically, a physiological saline solution). In this application, this bag is called the water supply bag 51 even if it is filled with a liquid other than water. The spike 52 is connected to the first water supply tube 54*a* via the first connector 53*a*. When the water supply bag 51 is pierced with the spike 52, this enables the supply of the liquid filling the water supply bag 51 to the first water supply tube 54*a*.

The first water supply tube 54*a* is connected to the subassembly 70 (see FIG. 8) via a second connector 53*b*. The control device 80 sends out the liquid in the subassembly 70 toward the handpiece 200 by a tube pump 600 (described later with reference to FIG. 8 or the like). Therefore, the control device 80 is a liquid supply device as well.

The subassembly 70 is connected to the third water supply tube 54*c* via the fifth connector 53*e*. The third water supply tube 54*c* is connected to the handpiece 200. The liquid supplied to the handpiece 200 via the third water supply tube 54*c* intermittently ejected from a nozzle 207 provided at the distal end (nozzle 207) of the ejection tube 205.

The intermittent ejection of the liquid is realized by the expansion and contraction of a piezoelectric element 360 (see FIG. 6) built in the handpiece 200. As the liquid is thus ejected intermittently, an excision ability can be secured with a low flow rate. In this way, the handpiece 200 is a liquid ejection unit which is supplied with the liquid sent out by the control device 80 and ejects the liquid.

The suction tube 41 is connected to the handpiece 200. The suction unit 40 sucks the content inside the suction tube 400 via the suction tube 41. By this suction, the liquid and excised fragments near the distal end of the suction tube 400 are sucked. In this way, the suction tube 400 is a tube through which a liquid used for a surgical operation flows, similarly to the ejection tube 205.

Figure 2:
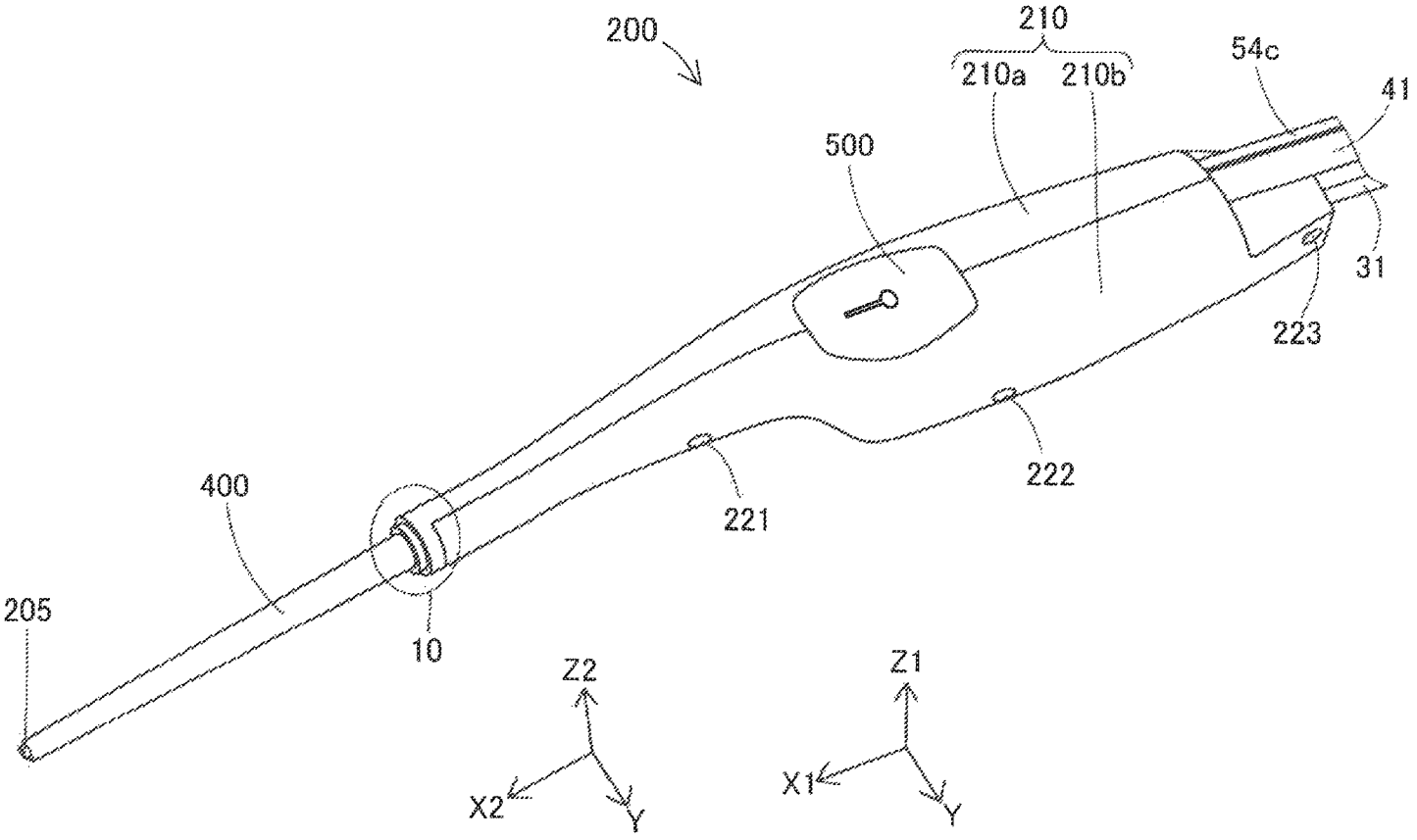
FIG. 2 is a perspective view of a handpiece.
Figure 3:
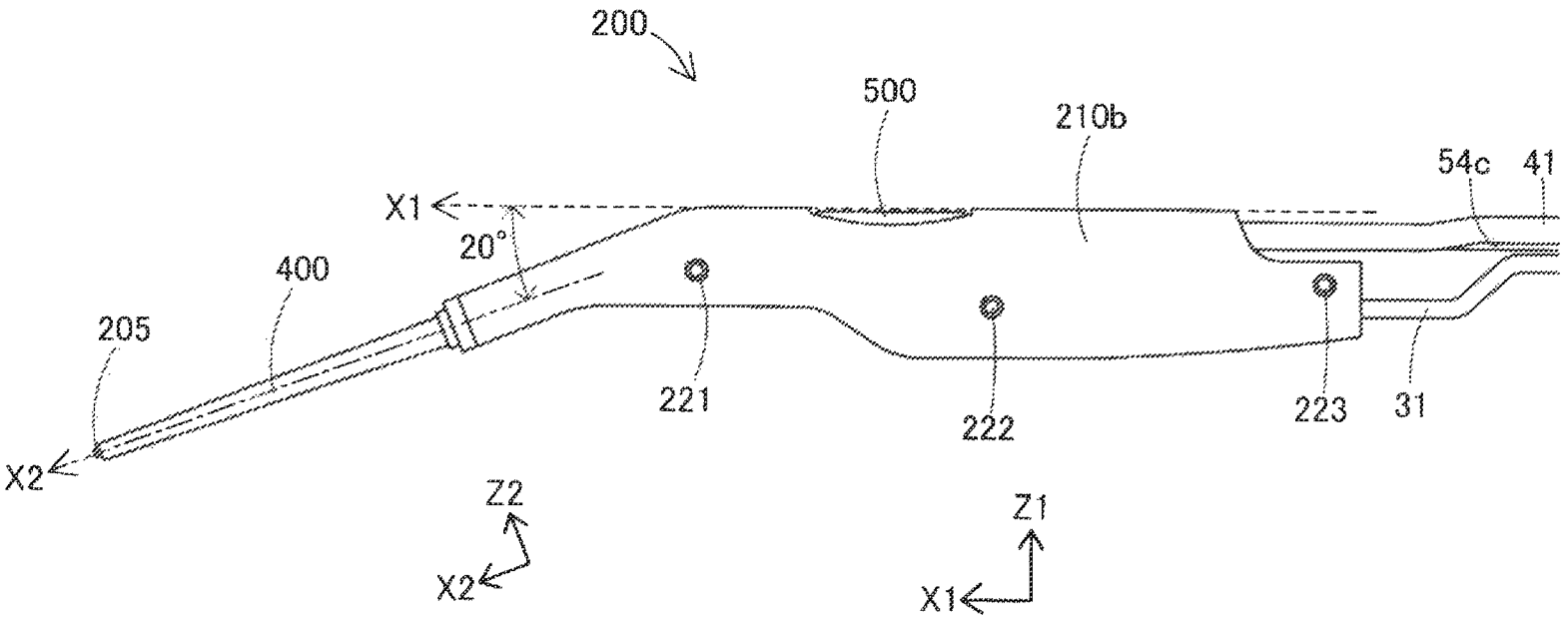
FIG. 3 is a side view of the handpiece.

FIG. 2 is a perspective view of the handpiece 200. FIG. 3 is a side view of the handpiece 200. The handpiece 200 includes the ejection tube 205, a casing 210, screws 221, 222, 223, the suction tube 400, and a suction force adjustment mechanism 500.

The casing 210 is a member gripped by the user. The casing 210 is formed by connecting a first housing 210*a* and a second housing 210*b* together. The ejection tube 205 is made of a metal and therefore electrically conductive. The casing 210 and the suction tube 400 are made of a hard resin.

As shown in FIGS. 2 and 3, two orthogonal coordinate systems with respect to the handpiece 200 are defined. The first is an X1-Y-Z1 coordinate system. The second is an X2-Y-Z2 coordinate system. The Y-direction common to the two coordinate systems is a direction orthogonal to the boundary line between the first housing 210*a* and the second housing 210*b*. The Y-direction from the first housing 210*a* toward the second housing 210*b* is the positive direction. The boundary line in this case is a line appearing on the surface of the casing 210, as shown in FIG. 2. However, the definition of the Y-direction excludes the boundary line near a connecting part 10.

The X1-direction is a direction parallel to a predetermined straight line included in the boundary line. The X1-direction toward the open end of the suction tube 400 is the positive direction. The predetermined straight Line is a straight line appearing on both sides of the suction force adjustment mechanism 500. The Z1-direction is defined by a right-hand system based on the X1-direction and the Y-direction.

The X2-direction is the longitudinal direction of the suction tube 400. The X2-direction toward the open end of the suction tube 400 is the positive direction. The Z2-direction is defined by a right-hand system based on the X2-direction and the Y-direction. In this embodiment, the angle between the X1-direction and the X2-direction is 20 degrees.

The second housing 210*b* is fixed to the first housing 210*a* by tightening the screws 221, 222, 223. Of the screws 221, 222, 223, the closest one to the negative side of the X1-direction is the screw 223. The position of the screw 223 is arranged near an end part on the negative side of the X1-direction of the casing 210. Therefore, near the end part on the negative side of the X1-direction of the casing 210, the second housing 210*b* is firmly fixed to the first housing 210*a*.

Of the screws 221, 222, 223, the closest one to the positive side of the X1-direction is the screw 221. The position of the screw 221 is slightly to the negative side of the X1-direction from an end part on the positive side of the X1-direction of the casing 210, that is, from the vicinity of the connecting part 10. This is for the purpose of designing the casing 210 to be narrower on the positive side of the X1-direction from the screw 221. However, the second housing 210*b* is firmly fixed to the first housing 210*a* even on the positive side of the X1-direction from the screw 221.

Figure 4:
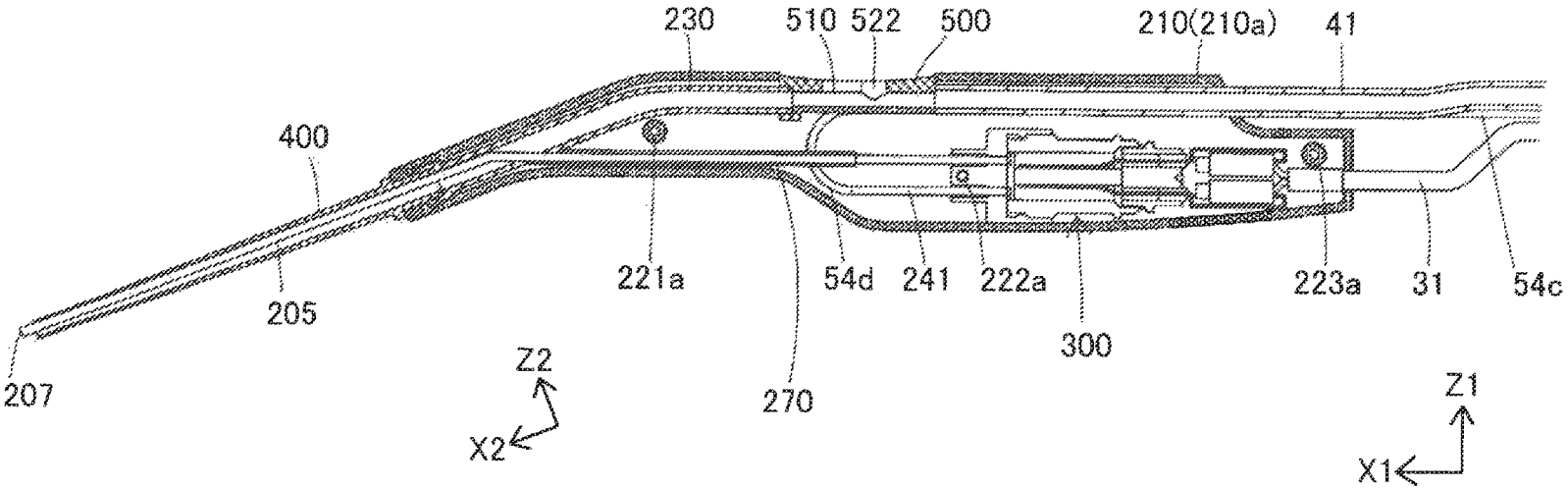
FIG. 4 is a cross-sectional view of the handpiece.
Figure 5:
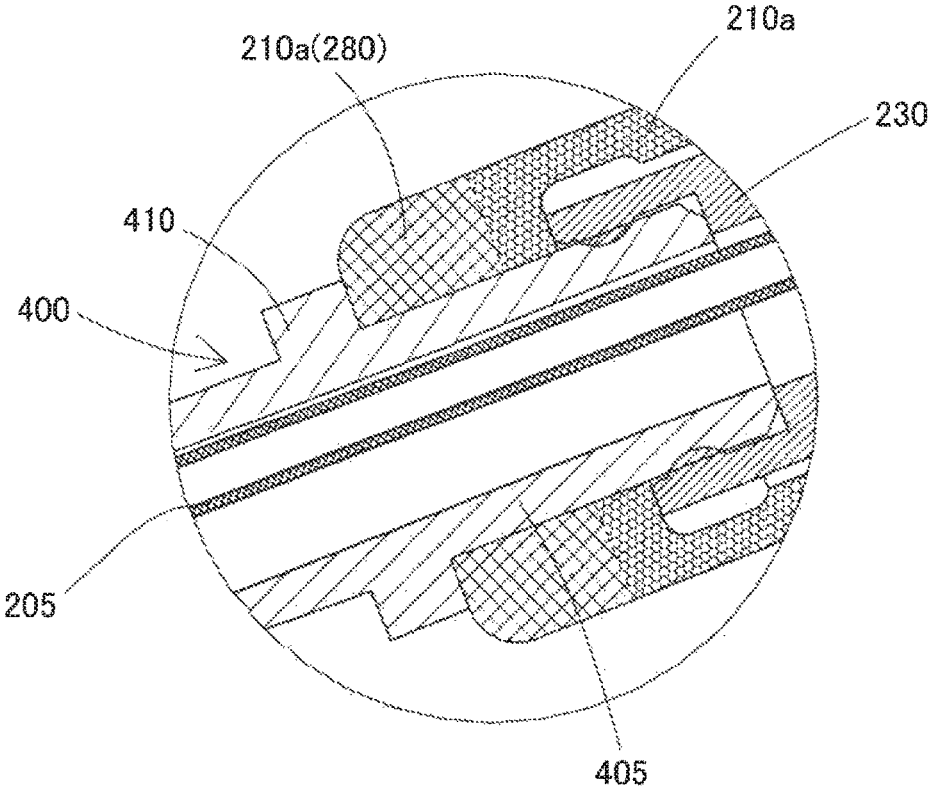
FIG. 5 is an enlarged view of FIG. 4.

FIG. 4 is a cross-sectional view of the handpiece 200. FIG. 5 is an enlarged view of the components shown in a circle in FIG. 4. Inside the casing 210, screw holes 221*a*, 222*a*, 223*a*, an inlet channel 241, an insulating member 270 (described later with reference to FIG. 7), and a drive unit 300 are provided.

The surface appearing as a cross section of the casing 210 in. FIGS. 4 and 5 is a mating surface of the first housing 210*a*. The mating surface of the first housing 210*a* is a surface which is orthogonal to the Y-direction and comes in contact with the second housing 210*b* when assembled as the casing 210. However, an area shown as a ring member 280 (described later) shown in the enlarged view in the circle is not the mating surface but a sectional surface of the ring member 280. The ejection tube 205 and the suction tube 400 penetrate the ring member 280.

The third water supply tube 54*c* is bent in a U-shape within the casing 210 and is connected to the inlet channel 241. The inlet channel 241 communicates with the ejection tube 205 via a liquid chamber 240 (see FIG. 7).

The channel diameter of the inlet channel 241 is smaller than the channel diameter of the ejection tube 205. Therefore, even if the pressure inside the liquid chamber 240 changes (as described later), the liquid in the liquid chamber 240 is restrained from flowing back to the inlet channel 241.

The casing 210 has the ring member 280. The attachment of the suction tube 400 is realized by fitting an insertion part 405 as a part of the suction tube 400 with the ring member 280 and thus bringing a flange 410 as a part of the suction tube 400 into contact with the ring member 280 of the first housing 210*a*. The channel inside the suction tube 400, thus attached, communicates with a suction channel member 230. The suction channel member 230 is more flexible than the ejection tube 205 and is made of a soft resin. The suction channel member 230 is connected to the suction tube 41 via the suction force adjustment mechanism 500.

The suction force adjustment mechanism 500 is provided with a suction channel member 510 which connects the suction channel member 230 with the suction tube 41, and a hole 522 communicating with the channel inside the suction channel member 510. The user can adjust the suction force of the suction tube 400, using the hole 522. Specifically, if the area of the opening of the hole 522 is reduced, the flow rate of the air flowing in from the hole 522 decreases and therefore, the flow rate of the fluid (air, liquid or the like) sucked via the suction tube 400 increases. That is, the suction force of the suction tube 400 increases. In contrast, if the area of the opening of the hole 522 is increased, the flow rate of the air flowing in from the hole 522 increases, too, and therefore the suction force of the suction tube 400 decreases. Normally, the user realizes the adjustment of the opening area of the hole 522 by adjusting the area of the closed portion of the hole 522 with a thumb. The shape of the hole 522 is designed in such a way that the suction force of the suction tube 400 is very small or none in the state where the hole 522 is not covered at all. In this embodiment, though the channel area of the suction tube 400 is larger than the opening area of the hole 522, the suction tube 400 has a sufficient length, thus making the channel resistance in the suction tube 400 greater than the channel resistance in the hole 522. Thus, the suction force of the suction tube 400 can be made very small when the hole 522 is not covered at all.

The screw holes 221*a*, 222*a*, 223*a* are provided in the first housing 210*a*. The screws 221, 222, 223 are screwed into the screw holes 221*a*, 222*a*, 223*a*. The screw 222 penetrates a hole 255 (see FIG. 6) provided in a channel connecting member 250 of the drive unit 300 and is inserted into the screw hole 222*a*.

Figure 6:
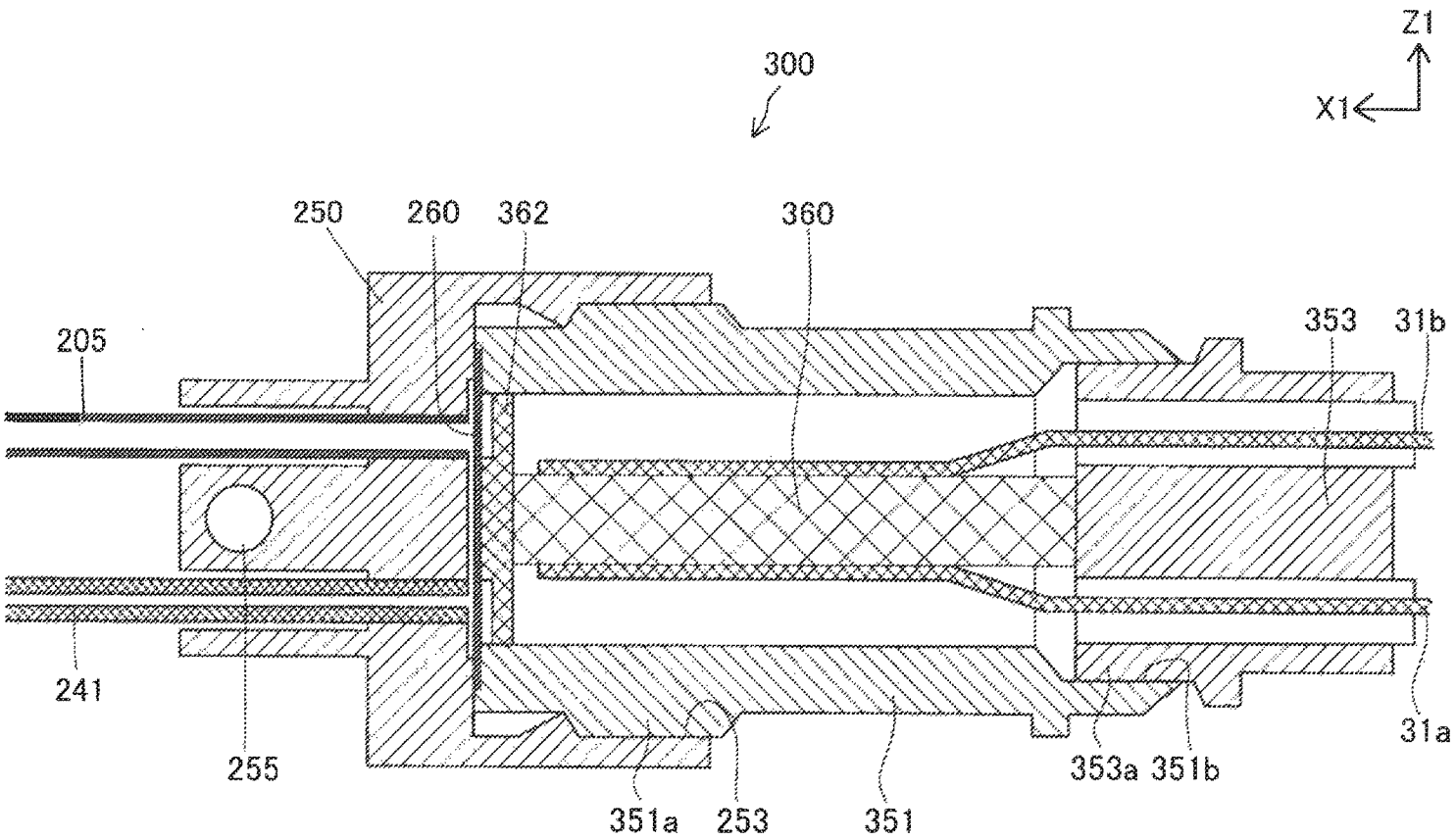
FIG. 6 is a cross-sectional view showing the vicinity of a drive unit in an enlarged manner.

FIG. 6 is a cross-sectional view showing the vicinity of the drive unit 300 in an enlarged manner. The drive unit 300 has the channel connecting member 250, a diaphragm 260, a cylindrical member 351, a fixed member 353, a piezoelectric member 360, and a piston 362.

The piezoelectric element 360 is a multilayer piezoelectric element. The piezoelectric element 360 is arranged within the cylindrical member 351 in such a way that the direction of its expansion and contraction is along the X1-direction.

The fixed member 353 is fixed to one end of the cylindrical member 351. Specifically, the fixed member 353 is fixed to one end of the cylindrical member 351, as a male screw 353*a* provided on the outer circumference of the fixed member 353 is tightened into a female screw 351*b* provided on the inner circumference of the cylindrical member 351.

The piezoelectric element 360 is fixed to the fixed member 353 with an adhesive. A first cable 31*a* and a second cable 31*b* forming the actuator cable 31 penetrate through-holes provided in the fixed member 353 and are electrically connected to the piezoelectric element 360.

The material of the diaphragm 260 is a metal, specifically stainless steel, and more specifically SUS 304 or SUS 316L. The diaphragm 260 is formed relatively thickly (for example, 300 μm) in order to apply a preload on the piezoelectric element 360. The diaphragm 260 is arranged in such a way as to cover the other end of the cylindrical member 351 and is fixed to the cylindrical member 351 by welding.

The piston 362 is fixed to one end of the piezoelectric element 360 with an adhesive and is arranged in contact with the diaphragm 260. The piston 362 is formed in such a shape that circular columns with different diameters are concentrically stacked on each other. The circular column with a smaller diameter is in contact with the diaphragm 260. Therefore, the diaphragm 360 is not pressed at its edge and therefore no large force acts on the welded site. The piston 362 and the diaphragm 260 are not fixed together with an adhesive or the like and are simply in contact with each other.

A male screw 351*a* is provided on the outer circumference of the cylindrical member 351. As the male screw 351*a* is tightened into a female screw 253 provided on the channel connecting member 250, the cylindrical member 351 is fixed to the channel connecting member 250.

The piezoelectric element 360 expands and contracts in response to a drive signal inputted via the actuator cable 31. As the piezoelectric element 360 expands and contracts, the piston. 362 vibrates in the longitudinal direction (X1-direction) of the piezoelectric element 360. As the piston 362 vibrates, the diaphragm 260 is deformed according to this vibration. The operation of causing the piezoelectric element 360 to expand and contract in response to a drive signal is referred to as driving the drive unit 300 (or driving the piezoelectric element 360).

Figure 7:
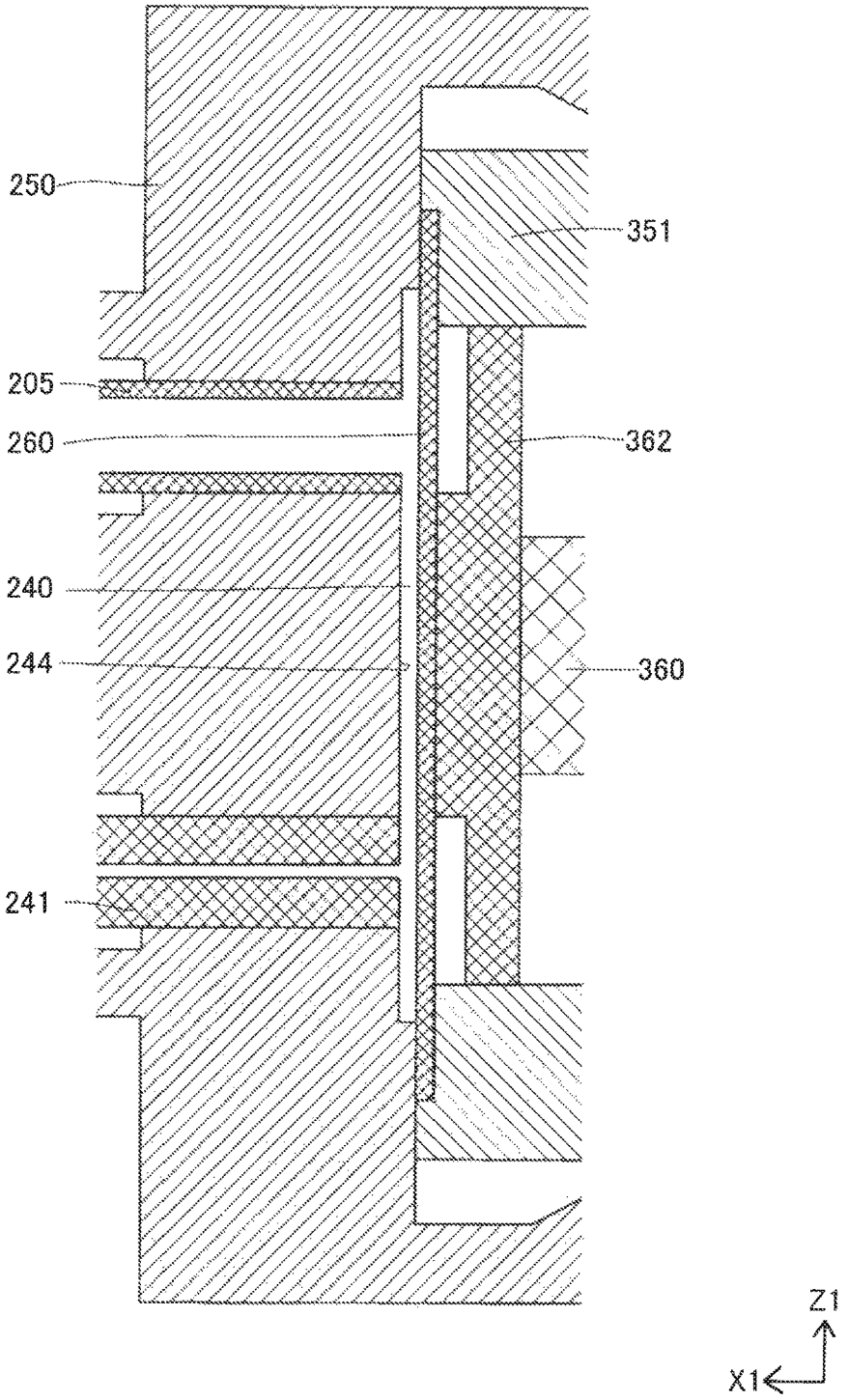
FIG. 7 is a cross-sectional view showing the vicinity of a diaphragm in an enlarged manner.

FIG. 7 shows an enlarged cross section near the diaphragm 260. A depression 244 is provided in the channel connecting member 250. The depression 244 is a site depressed in a thin circular shape in the channel connecting member 250. The diaphragm 260 covers the depression 244, thus forming the liquid chamber 240. The liquid chamber 240 thus formed is arranged downstream of a second water supply tube 54*b* and can communicate with the ejection tube 205 for ejecting a liquid.

When the diaphragm 260 is deformed, the capacity of the liquid chamber 240 changes. With this change, the pressure of the liquid filling the liquid chamber 240 changes. When the pressure in the liquid chamber 240 drops, the liquid flows into the liquid chamber 240 from the inlet channel 241. When the pressure in the liquid chamber 240 rises, the liquid flows out of the liquid chamber 240 into the ejection tube 205. The reason why the liquid flows in this direction is that the channel diameter of the inlet channel 241 is smaller than the channel diameter of the ejection tube 205, as described above.

The liquid flowing out into the ejection tube 205 is ejected from the nozzle 207 provided at the distal end (nozzle 207) of the ejection tube 205. Since the pressure rise in the liquid chamber 240 is intermittent, the ejection of the liquid from the nozzle 207 is carried out intermittently.

Figure 8:
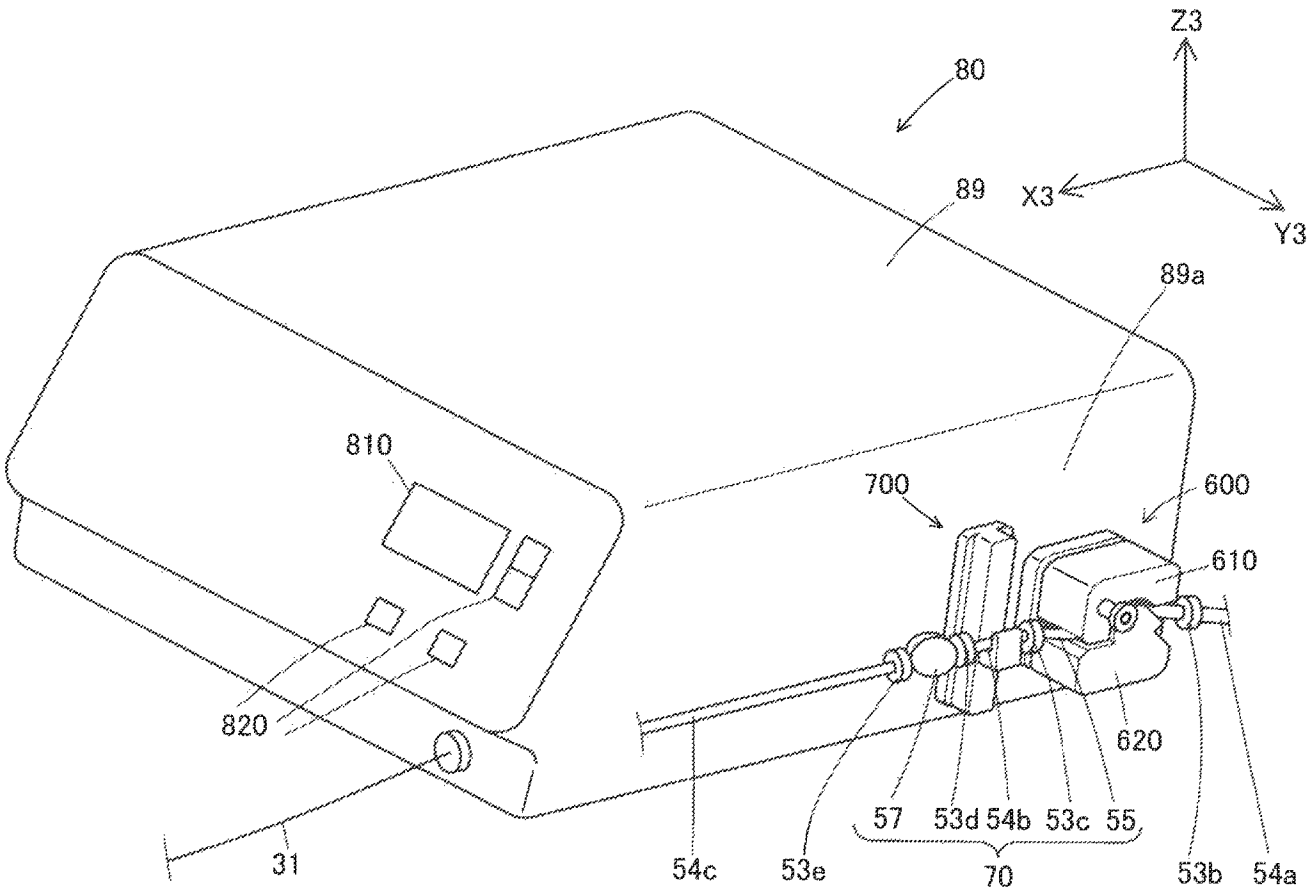
FIG. 8 is a perspective view of a control device.

FIG. 8 is a perspective view of the control device 80. The control device 80 has a casing 89, the tube pump 600, a blockage detection mechanism 700, a display panel 810, and an operation switch group 820. The control device 80 is also a blockage detection device because it has the blockage detection mechanism 700.

Figure 9:
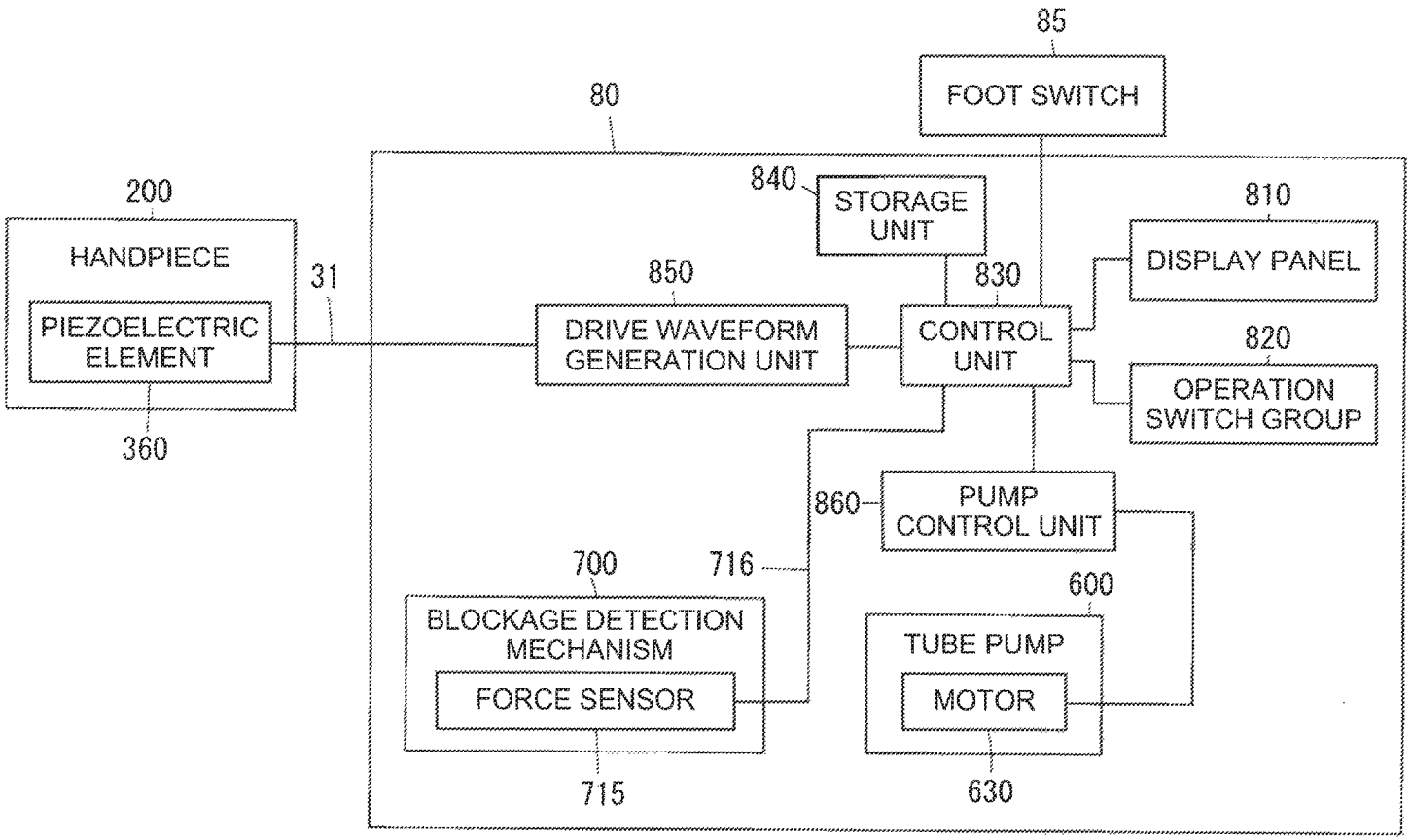
FIG. 9 is a functional block diagram of the surgical device.

FIG. 9 is a functional block diagram of the surgical device 20. The control device 80 also has a control unit 830, a storage unit 840, a drive waveform generation unit 850, and a pump control unit 860, in addition to the foregoing configuration. These components will be described below, referring to FIGS. 8 and 9.

The tube pump 600 and the blockage detection mechanism 700 are provided on the external side of the casing 89. Specifically, the blockage detection mechanism 700 and the tube pump 600 are provided on a sidewall 89*a* which is a part of the casing 89.

With respect to the control device 80, an X3-Y3-Z3 coordinate system is defined as shown in FIG. 8. The X3-Y3-Z3 coordinate system is an orthogonal coordinate system and is defined by a right-hand system. The Z3-direction is a direction orthogonal to a bottom surface of the casing of the control device 80. The bottom surface is an installation surface which comes into contact with a horizontal table when the control device 80 is placed on the table. In the following description, it is assumed that the control device 80 is placed on a horizontal table. The positive side of the Z3-direction is the upward side of the vertical direction. The X3-direction is parallel to the sidewall 89*a*. The positive side of the X3-direction is the direction in which a liquid is sent out by the tube pump 600. The Y3-direction is defined by a right-hand system based on the relationship between the X3-axis and the Z3-axis.

The display panel 810 displays a notification item to the user. The notification item may be, for example, the mode of the surgical device 20 (startup mode, use-available mode or the like), or an error message (occurrence of a blockage) or the like. The operation switch group 820 is an input interface for designating the startup, finish or the like of the surgical device 20.

The blockage detection Mechanism 700 is a mechanism for detecting a blockage in the second water supply tube 54*a*, the third water supply tube 54*c*, and the channels in the hand piece 200, and a clogging of a filter 57, by measuring the force of expansion of the second water supply tube 54*b* (blockage detection tube) (details of which will be described later with reference to FIGS. 10 and 11). If such a blockage or clogging occurs, the amount of the liquid ejected from the handpiece 200 becomes smaller than the amount of the liquid supplied by the tube pump 600. In some cases, no liquid is ejected.

The storage unit 840 shown in FIG. 9 is made up of a ROM (read only memory), RAM (random access memory) or the like, and stores a program for controlling the tube pump 600 and the piezoelectric element 360. As the control unit 830 made up of a CPU (central processing unit) or the like executes this program, the output of a first drive signal and a second drive signal is realized while the foot switch 85 is being pressed. The first drive signal is generated by the drive waveform generation unit 850. The second drive signal is generated by the pump control unit 860.

In the embodiment, the first drive signal has a periodicity of 400 Hz and causes the piezoelectric element 360 to expand and contract. The second drive signal is transmitted within the casing 89 and drives a motor 630 included in the tube pump 600. Hereinafter, the operation of driving the motor 630 is also referred to as driving the tube pump 600. With the configuration described above, the liquid is intermittently elected while the user is pressing the foot switch 85, and the ejection of the liquid is stopped while the user is not pressing the foot switch 85.

As shown in FIG. 8, the subassembly 70 has third and fourth connectors 53*c*, 54*d*, the second water supply tube 54*b*, the pump tube 55, and the filter 57. The subassembly 70 is a concept introduced for the sake of convenience of the description of the embodiment and therefore is not particularly distinguished from the other members in terms of functions and manufacturing.

The first water supply tube 54*a* is connected to the pump tube 55 via the second connector 53*b*. The pump tube 55 is connected to the second water supply tube 54*b* via the third connector 53*c*. In the tube pump 600, the pump tube 55 is held between a stator 610 and a roller 621 which is arranged in a housing 620 (see FIG. 10).

In the tube pump 600, the roller 621 is rotated by the rotation of the motor 630 arranged within the casing 89, thus squeezing the pump tube 55. As the pump tube 55 is thus squeezed, the liquid in the pump tube 55 is sent out toward the second water supply tube 54*b* from the side of the first water supply tube 54*a*.

The second water supply tube 54*b* is connected to the third water supply tube 54*c* via the fourth connector 53*d*, the filter 57, and the fifth connector 53*e*. Therefore, it can be said that the operation of the tube pump 600 is for sending out the liquid in the second water supply tube 54*b* toward the handpiece 200. The filter 57 captures foreign matters and gases (for example, air) included in the liquid. The filter 57 is configured in such a way as to spontaneously discharge the captured gases from the filter 57.

The blockage detection mechanism 700 has a force sensor 715. The force sensor 715 inputs a signal for detecting a blockage, to the control unit 830. The blockage detection mechanism 700 will be described below.

Figure 10:
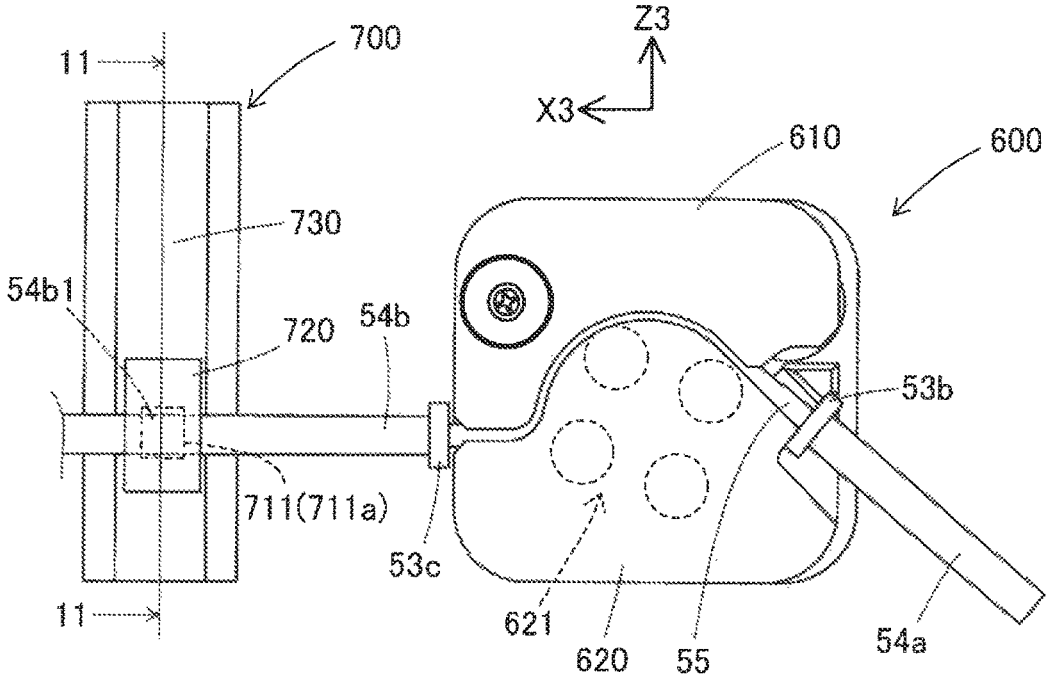
FIG. 10 is an enlarged view showing the vicinity of a blockage detection mechanism and a tube pump.

FIG. 10 is an enlarged view of the vicinity of the tube pump 600 and the blockage detection mechanism 700. FIG. 11 is a cross-sectional view taken along 11-11 in FIG. 10. FIG. 12 is an enlarged view of the components shown in a circle in FIG. 11, in the case where the second water supply tube 54*b* is not provided. As shown in FIGS. 10 and 11, the blockage detection mechanism 700 has a sensor unit 710, a receiving part 720, a base part 730, and bolts 751, 752, 761, 762, 770.

The base part 730 is fixed to the sidewall 89*a*, as shown in FIG. 8. The term "fix" in this application means that no mechanism for changing the relative positional relationship is used. This is an expression that allows slight changes in the positional relationship due to elastic deformation.

The sensor unit 710 is arranged on the inner side of the base part 730 (on the negative side of the Y3-direction) The sensor unit 710 has a transmission part 711 and the force sensor 715. The transmission part 711 has an action surface 711*a*. The force sensor 715 is fixed to the transmission part 711 with the bolts 751, 752. The force sensor 715 is fixed to the base part 730 with the bolts 761, 762. Therefore, the sensor unit 710 is fixed directly to the base part 730. That is, the force sensor 715 has its relative positional relationship with the base part 730 fixed.

Figure 11:
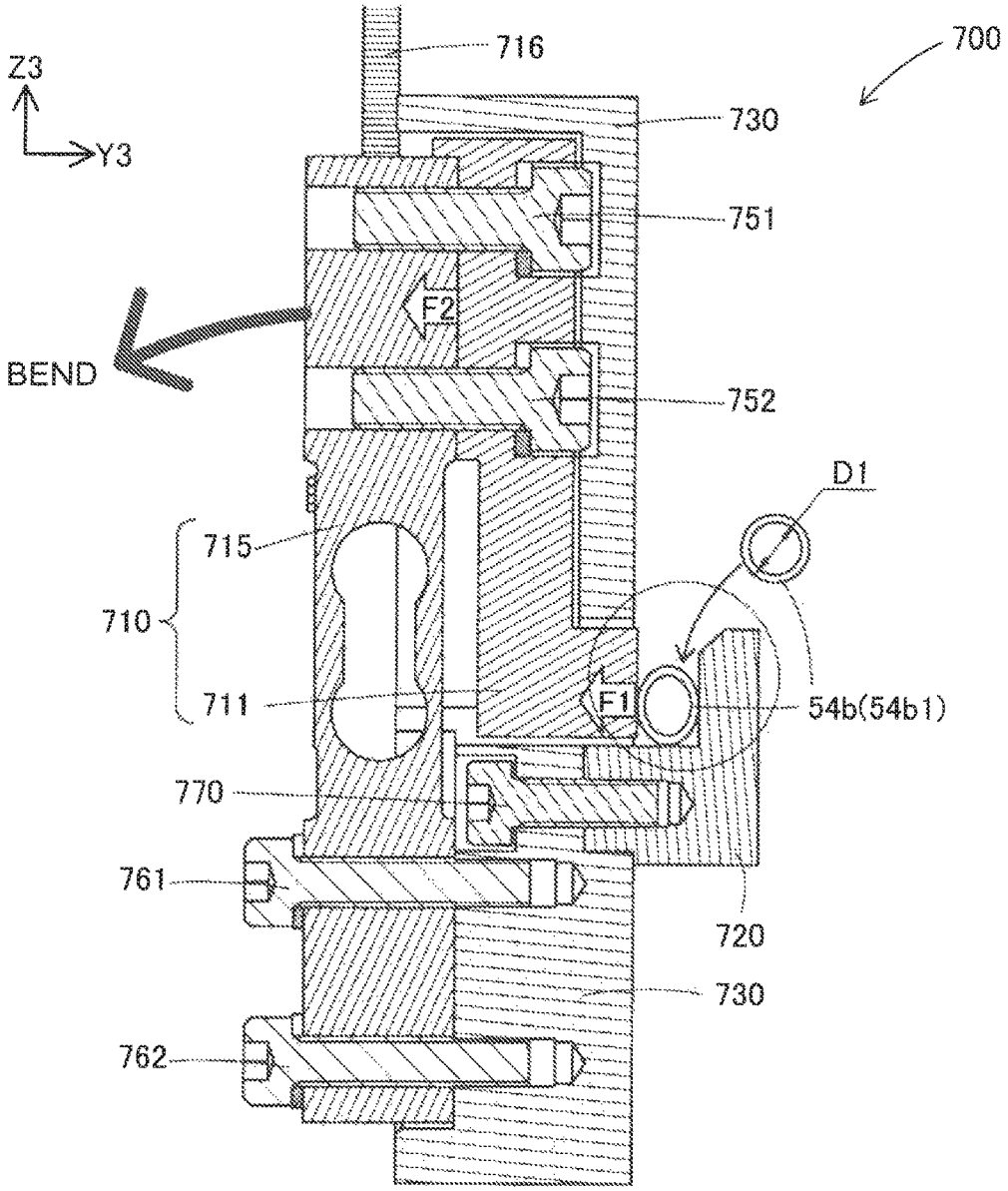
FIG. 11 is a cross-sectional view taken along 11-11 in FIG. 10.
Figure 12:
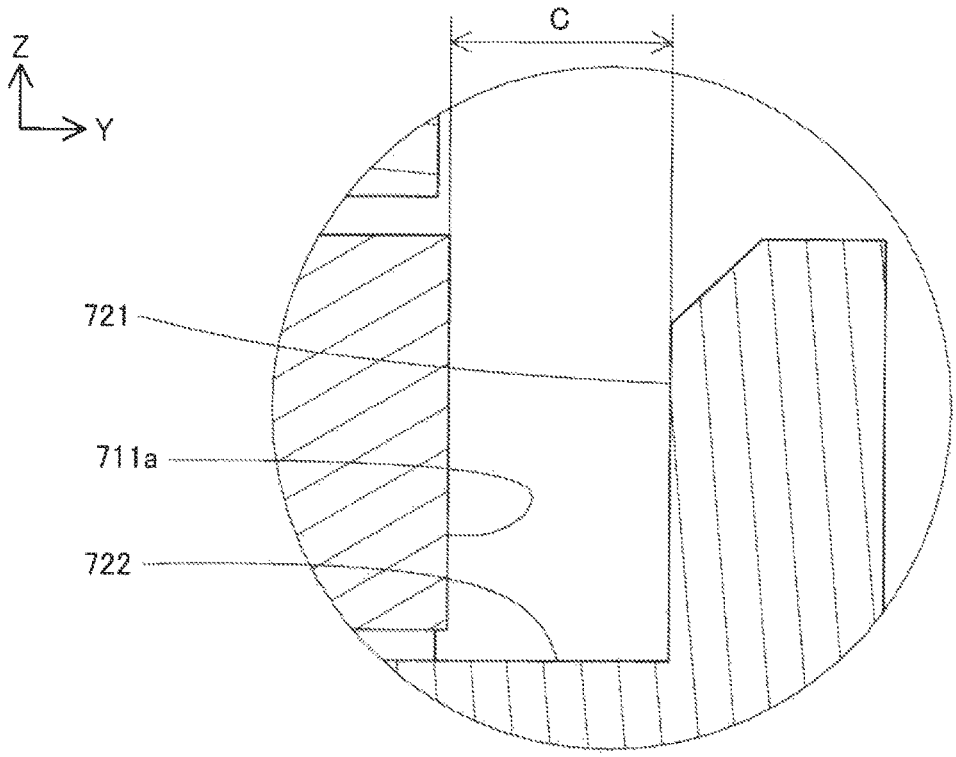
FIG. 12 is an enlarged view of FIG. 11.

As shown in FIG. 11, the receiving part 720 is arranged on the outer side of the base part 730 (on the positive side of the Y3-direction) The receiving part 720 is fixed directly to the base part 730 with the bolt 770. That is, the receiving part 720 has its relative positional relationship with the base part 730 fixed. Consequently, the receiving part 720 is fixed to the sensor unit 710 via the base part 730.

The receiving part 720 has a substantially L-shaped cross section. However, in FIG. 11, the shape of the receiving part 720 is illustrated as a L-shape rotated 90 degrees counter-clockwise. The receiving part 720 has a counter-surface 721 which faces the action surface 711*a*. The counter-surface 721 is parallel to the action surface 711*a*.

The action surface 711*a* is apart of the transmission part 711 and exposed from the base part 730. The action surface 711*a* protrudes outward (on the positive side of the Y3-direction) from the surface of the base part 730. A clearance C (see FIG. 12) between the receiving part 720 and the action surface 711*a* is smaller than an outer diameter D1 of the second water supply tube 54*b*.

The "outer diameter D1 of the second water supply tube 54*b*" is a dimension in the case where the second water supply tube 54*b* is not held between the receiving part 720 and the action surface 711*a* and where the second water supply tube 54*b* is not filled with any liquid. If the second water supply tube 54*b* is filled with a liquid, the outer diameter of the second water supply tube 54*b* becomes slightly greater than the outer diameter D1. As a matter of course, the clearance C is smaller than the outer diameter of the second water supply tube 54*b* in the case where the second water supply tube 54*b* is filled with a liquid as well.

With such a dimensional relationship, when the second water supply tube 54*b* is held between the receiving part 720 and the action surface 711*a*, the second water supply tube

54*b* is compressed and deformed in the Y3-direction and comes in tight contact with the action surface 711*a*. Hereinafter, the state where the second water supply tube 54*b* is held and gripped between the receiving part 720 and the action surface 711*a* is referred to as a set state. The holding of the second water supply tube 54*b* between the receiving part 720 and the action surface 711*a* is hereinafter referred to as "to set the second water supply tube 54*b*" or simply as "to set".

In order to set, it suffices to insert the second water supply tube 54*b* between the receiving part 720 and the action surface 711*a* and bring the second water supply tube 54*b* into contact with a lower surface 722 of the receiving part 720. Therefore, compared with the case where the setting is carried out using a dynamic mechanism such as a hinge, the setting can be realized by simple work and the contact force between the second water supply tube 54*b* and the action surface 711*a* is stabilized. Also, since the action surface 711*a* protrudes outward from the base part 730, the contact force between the second water supply tube 54*b* and the action surface 711*a* is stabilized. In the set state, a site in contact with the action surface 711*a*, and a site at the same position in the X3-direction as the site in contact with the action surface 711*a*, of the second water supply tube 54*b*, are called a detection target site 54*b*1.

Since the counter-surface 721 and the action surface 711*a* are parallel to each other, the frictional force at the time of moving the second water supply tube 54*b* in the Z3-direction is stabilized during the setting work. Therefore, failure to set the second water supply tube 54*b* due to an insufficient movement of the second water supply tube 54*b* in the Z3-direction can be restrained.

The second water supply tube 54*b* in the set state pushes the action surface 711*a* to the negative side of the Y3-direction with a force F1 corresponding to the pressure of the liquid in the detection target site 54*b*1 (hereinafter referred to as in-tube pressure). This pushing force acts with high sensitivity on the action surface 711*a* because the second water supply tube 54*b* is in tight contact with the action surface 711*a* as described above.

The action surface 711*a* is situated at the end on the negative side of the Z3-direction of the transmission part 711, as shown in FIG. 11. The vicinity of the end on the positive side of the Z3-direction of the transmission part 711 is fixed to the vicinity of the end of the positive side of the Z3-direction of the force sensor 715 with the bolts 751, 752.

Therefore, the force F1 is transmitted to the force sensor 715 via the transmission part 711 The force transmitted to the force sensor 715 has the magnitude of a force F2 and pushes to the negative side of the Y3-direction.

The vicinity of the end on the negative side of the Y3-direction of the force sensor 715 is fixed to the base part 730 with the bolts 761, 762. Therefore, the force sensor 715 is formed as a cantilever with the bolts 761, 762 working as fixed ends. The force F2 acts on the site corresponding to the free end of the cantilever, as described above. Consequently, bending with a magnitude corresponding to the force F2 is generated in the force sensor 715. The force sensor 715 has a piezoelectric element, which outputs an electrical signal based on a voltage corresponding to the magnitude of the bending. The outputted electrical signal is inputted to the control unit 830 via a signal line 716.

The force F2 is decided according to the force F1. Therefore, bending with a magnitude corresponding to the force F1 is generated in the force sensor 715. The force F1 is a force with a magnitude corresponding to the in-tube pressure, as described above. Consequently the output value from the force sensor 715 is a value which reflects the in-tube pressure.

If the tube pump 600 is still driven even when a blockage has occurred in the second water supply tube 54*b*, the third water supply tube 54*c*, and the channels in the handpiece 200, the in-tube pressure has a greater value than when no blockage has occurred. Therefore, a blockage can be detected using the output value from the force sensor 715. Specifically, the control unit 830 determines that a blockage has occurred if the output value from the force sensor 715 has reached a threshold. If the control unit 830 determines that a blockage has occurred, the control unit 830 displays that a blockage has occurred, on the display panel 810. Also, if the control unit 820 determines that a blockage has occurred, the control unit 830 does not carry out the output of the first drive signal and the second drive signal even if the foot switch 85 is pressed. That is, the tube pump 600 is stopped and the infusion operation is stopped.

In the embodiment, the in-tube pressure in normal time is approximately 70 kPa to 80 kPa. The in-tube pressure at which it is determined that a blockage has occurred is set to 350 kPa.

In order to carry out the blockage detection successfully, the clearance C is set to 5.3 mm. Also, the design values and material of the second water supply tube 54*b* are defined as follows. The outer diameter D1 is 6±0.1 mm. The inner diameter is 2.5±0.1 mm. The material is silicone rubber. The hardness is 50 or above and 80 or below (preferably around 70). The hardness in this embodiment is a value measured by a Shore A durometer. Shore A hardness is also referred to durometer A hardness. The wall thickness of the second water supply tube 54*b* is 1.55 mm or more and 1.85 mm or less, based on the design values of the outer diameter D1 and the inner diameter.

The pump tube 55 is made of olefin-based elastomer. The median of the inner diameter is designed to be 0.95 mm. The median of the outer diameter is designed to be 4.0 mm. The hardness is designed to be 69. Meanwhile, the design values and material of the third water supply tube 54*c* are designed similarly to those of the second water supply tube 54*b*. As for the first water supply tube 54*a*, the median of the inner diameter is designed to be 3.0 mm and the median of the outer diameter is designed to be 5.0 mm. The ball size of the filter 57 is designed to be 2 μm.

The receiving part 720 is fixed to the base part 730, as described above. Meanwhile, the action surface 711*a* moves to the negative side of the Y3-direction at the time of the setting, but the amount of its displacement is very small compared with the amount of deformation of the second water supply tube 54*b*. Therefore, there is little variation in the force acting on the action surface 711*a* due to the way the user applies a force when carrying out the setting.

As shown in FIG. 10, the action surface 711*a* is situated between the upper end and the lower end of the tube pump 600 in terms of the Z3-direction. That is, the action surface 711*a* is situated between the upper end of the stator 610 and the lower end of the housing 620 in terms of the Z3-direction. With this arrangement, the hydrostatic pressure component is stabilized. Therefore, there is no significant increase or decrease in the in-tube pressure with reference to the pressure in the channel near the third connector 53*c*. Thus, the detection of a blockage is stabilized.

As shown in FIGS. 8 and 10, the blockage detection mechanism 700 and the tube pump 600 are provided closely to each other. Therefore, failure to set the second water supply tube 54*b* despite setting the pump tube 55 in the tube pump 600 is restrained.

Next, the calibration of the force sensor 715 will be described. The force sensor 715 has the property of being able to detect the amount of change in force with high accuracy. Meanwhile, in the detection of the absolute value of a force, the force sensor 715 has large individual differences and therefore has low accuracy unless calibration is carried out. Therefore, calibration is carried out every time the use of the surgical device 20 is started.

Figure 13:
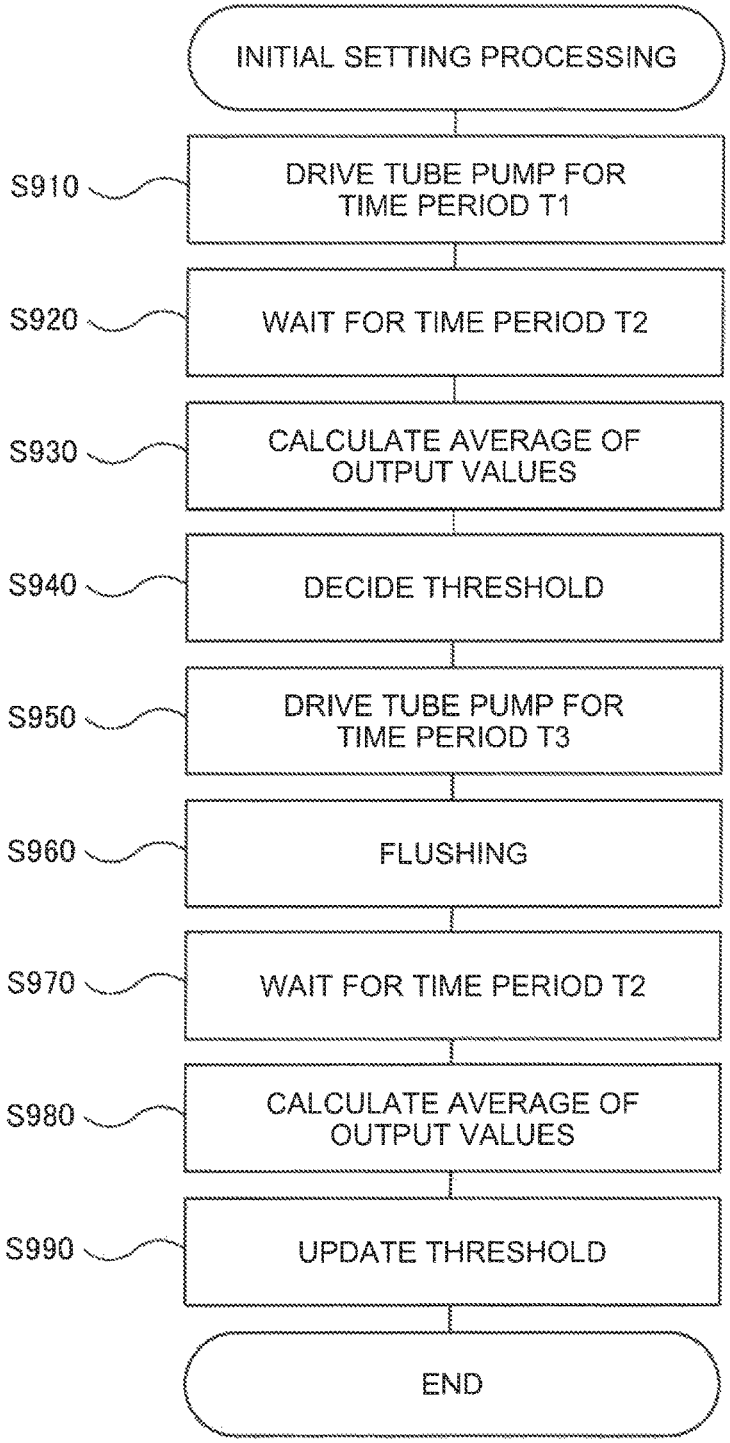
FIG. 13 is a flowchart showing initial setting processing including calibration.

FIG. 13 is a flowchart showing initial setting processing including calibration. The control unit 830 executes initial setting processing, taking the designation of the initial setting of the surgical device 20 via the operation switch group 820 as a cue. The storage unit 840 is used for the initial setting processing when appropriate.

Figure 14:
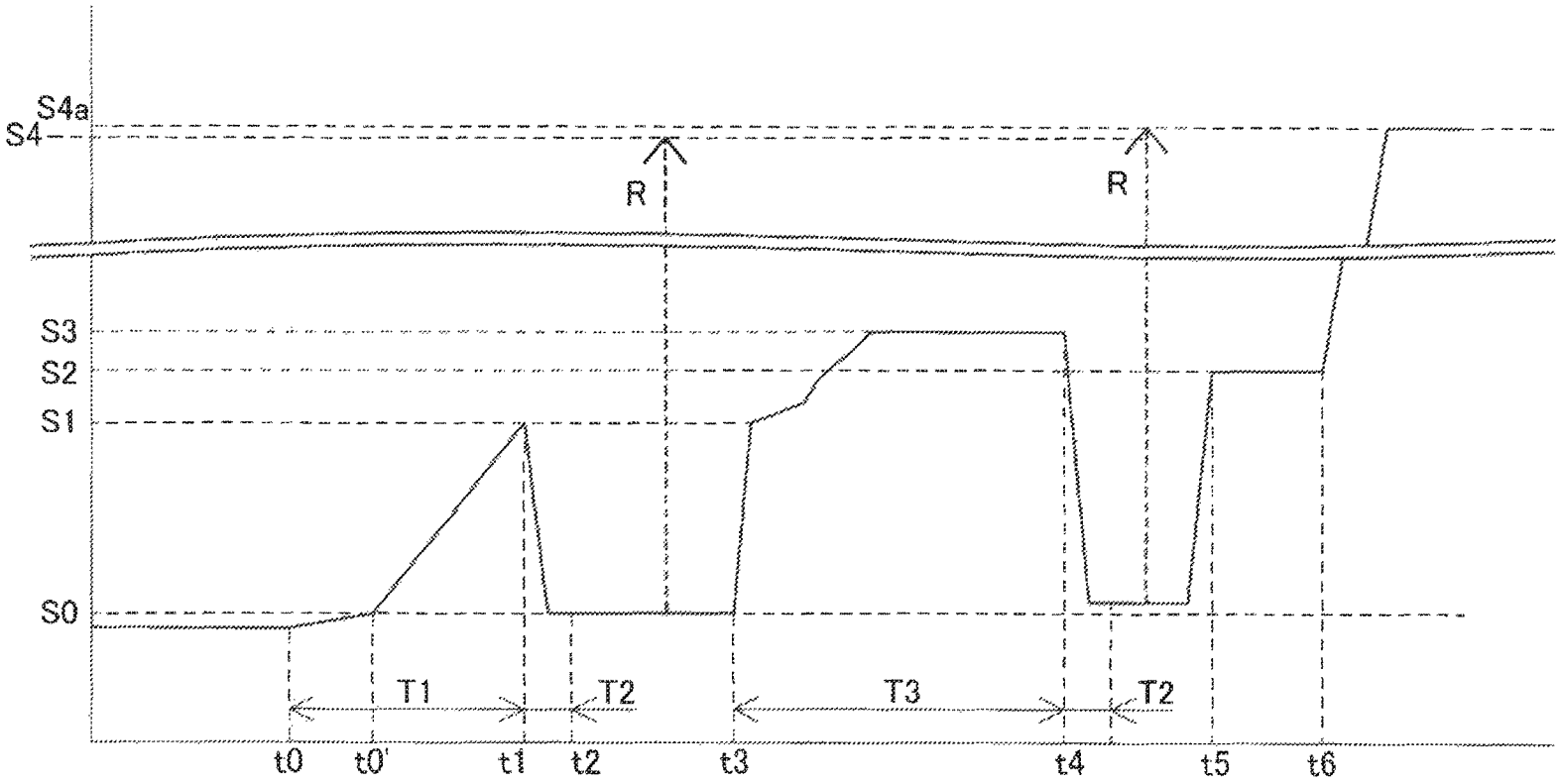
FIG. 14 is a graph schematically showing the relationship between the output value of a force sensor and time.

FIG. 14 is a graph schematically showing the relationship between the output value from the force sensor 715 (hereinafter simply referred to as the "output value") and time. Referring to FIG. 14, the processing will be described below.

First, the tube pump 600 is driven for a time period T1 (time t0 to time t1) (Step S910). Step S910 is carried out for the purpose of causing the liquid to reach at least the second water supply tube 54*b*. More specifically, this step is carried out for the purpose of causing the liquid to reach the detection target site 54*b*1.

As shown in FIG. 14, the output value gently increases due to the compression of air in the second water supply tube 54*b* until the liquid reaches the second water supply tube 54*b* (until time t0'). As the liquid reaches the second water supply tube 54*b*, the amount of increase in the output value become greater. As shown in FIG. 14, the output value rises to an output value S1 by Step S910.

In the embodiment, the time period T1 is set to be 15 seconds so that the purpose is sufficiently achieved. In Step S910, the tube pump 600 is driven in such a way that the flow rate of the liquid supplied by the tube pump 600 is 10 ml/min. At the end of Step S910, the liquid has not reached the handpiece 200 yet.

Subsequently, after the tube pump 600 is stopped, the processing waits for a time period T2 (time t1 to time t2) (Step S920). The purpose of Step S920 is to create a state where an output value to be a reference value (zero point) is obtained. When the tube pump 600 is stopped, no pressure drop occurs there. Therefore, the in-tube pressure quickly drops. Then, the in-tube pressure is stabilized while the processing waits for the time period T2. The stabilized in-tube pressure is the pressure based on hydrostatic pressure. Therefore, the stabilized in-tube pressure is appropriate as a reference value for blockage detection. In the embodiment, the time period T2 is set to be 1 second. Satisfying the condition that the liquid reaches at least the second water supply tube 54*b* and that the tube pump 600 is stopped in this way, is expressed as satisfying a first condition (predetermined condition).

Next, an output value is acquired multiple times and the average of these is calculated (Step S930). The acquisition of the output values is carried out from time t2 to time t3. Hereinafter, the average value obtained in Step S930 is called an output value S0. The output value S0 is an output value as the above-described reference value. The output value S0 is a value which reflects the hydrostatic pressure acting on the second water supply tube 54*b*.

Next, a predetermined value R is added to the output value S0, thus deciding a threshold S4 (Step S940). With the decision of the threshold S4, the calibration is completed for the moment. In the embodiment, the threshold S4 is a value equivalent to an in-tube pressure of approximately 350 kPa.

Subsequently, as shown in FIG. 13, the tube pump 600 is driven for a time period T3 (time t3 to time t4) (Step S950). In Step S950, the tube pump 600 is driven in such a way that the flow rate of the liquid supplied is 10 ml/min. Step S950 is carried out for the purpose of causing the liquid to reach the distal end (nozzle 207) of the ejection tube 205 provided in the handpiece 200. As the liquid reaches the distal end (nozzle 207) of the ejection tube 205, the pressure drop does not increase. Therefore, the in-tube pressure is stabilized and the output value, too, is stabilized at an output value S3. The threshold S4 is decided to be a greater value than the output value S3.

Figure 15:
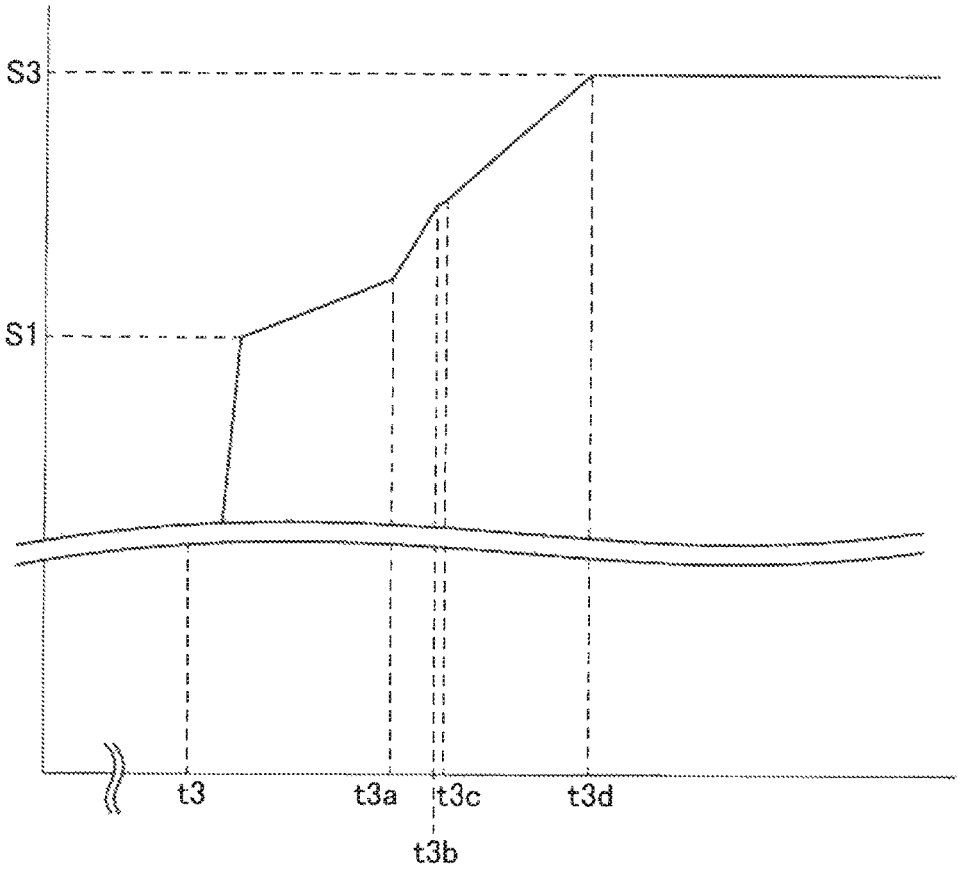
FIG. 15 is a graph showing the vicinity of time t3 to time t4 in FIG. 14 in an enlarged manner.

FIG. 15 is a graph showing the graph at time t3 and onward in FIG. 14, in an enlarged manner. Immediately after time t3, the output value quickly rises to the value (S1) corresponding to the pressure drop generated in the portion up to the site which the liquid has already reached. Reflecting the increase in the pressure drop by the third water supply tube 54*c*, the output value increases for a while.

At time t3*a*, the speed of increase in the output value increases. This is due to the liquid reaching the inlet channel 241 of the handpiece 200. It is because the inlet channel 241 has a smaller channel diameter than the third water supply tube 5*c* and therefore has a larger pressure drop.

After that, as the liquid reaches the liquid chamber 240 at time t3*b*, the speed of increase in the output value becomes gentler. This is because the liquid chamber 240 expands in the Y1-direction and has a larger channel area than the inlet channel 241.

Subsequently, as the liquid reaches the ejection tube 205 at time t3*c*, the speed of increase in the output value increases. This is because the ejection tube 205 has a smaller channel area than the liquid chamber 240. Then, at time t3*d* and onward, the output value is stabilized at the output value S3, as described above.

If the output value increases beyond the output S3 and reaches the threshold S4 during Step S950, the control unit 830 stops the tube pump 600 and suspends the initial setting processing. The causes of the output value reaching the threshold S4 during Step S950 may be an initial defect of the handpiece 200, bending of the third water supply tube 54*c*, and the like.

Subsequently, flushing is carried out (Step S960). Specifically, the tube pump 600 is driven in such a way that the flow rate of the liquid supplied is 8 ml/min, and the piezoelectric element 360 is made to expand and contract, thus discharging air bubbles remaining in the liquid chamber 240. In Step S960, a signal with a voltage of 80 V and a frequency of 50 Hz is inputted as the first drive signal to the piezoelectric element 360. In FIG. 14, the change in the output value due to the flushing is not illustrated.

After that, the tube pump 600 is stopped and the processing waits for the time period T2 (Step S970). An output value is acquired multiple times and the average value of these is calculated (Step S980). The threshold is updated with a value S4*a* obtained by adding a predetermined value R to the average value calculated in Step S980, as a new threshold (Step S990). Then, the initial setting processing ends.

Satisfying the condition that the liquid has reached the liquid chamber 240 and that the tube pump 600 is stopped as described above, is expressed as satisfying a second condition. If the second condition is satisfied, the first condition is necessarily satisfied. In Step S970, the second condition is satisfied and the liquid has reached the distal end (nozzle 207) of the ejection tube 205.

The reason for updating the threshold as described above is that if the output value in the state where the liquid has reached the distal end (nozzle 207) of the ejection tube 205 is used as a reference value, a more appropriate threshold can be set in detecting whether there is a blockage at the time of using the surgical device 20 or not.

After the initial setting processing, as the user presses the foot switch 85, the tube pump 600 is driven and the output value becomes approximately an output value S2, as shown in the graph from time t5 to time t6 in FIG. 14. The output value S2 is a value smaller than the output value S3 and equivalent to an in-tube pressure of approximately 70 to 80 kPa. The reason why the output value S2 is smaller than the output value S3 is that the flow rate of the liquid supplied by the tube pump 600 is set to be 4 ml/min after the initial setting processing.

As shown in the graph at time t6 and onward in FIG. 14, when blockage occurs, the output value quickly increases and reaches the threshold S4*a*. As the output value reaches the threshold S4*a*, the control unit 830 stops the tube pump 600. Therefore, arise in the in-tube pressure is avoided and the increase in the output value stops as well, as shown in FIG. 14.

According to this embodiment, the detection of a blockage can be carried out with high accuracy, by properly executing the calibration of the force sensor 715.

The invention is not limited to the embodiments, examples and modifications in this description and can be realized with various configurations without departing from the scope of the invention. For example, technical features in the embodiments, examples and modifications corresponding to technical features in the respective configurations described in the summary section can be replaced or combined when appropriate, in order to solve a part or the entirety of the foregoing problems, or in order to achieve a part or the entirety of the foregoing advantageous effects. Such technical features can be omitted when appropriate, unless described as essential in the description. For example, the following examples may be employed.

The receiving part and the action surface may be realized by any structure, provided that the relative positional relationship between these is fixed and that the second water supply tube filled with a liquid can be inserted and thus deformed and gripped between the receiving part and the action surface. For example, the following (a), (b) and (c) may be employed.

(a) The action surface need not necessarily protrude outward from the surface of the base part.

(b) The action surface need not necessarily be parallel to the counter-surface. For example, the counter-surface may be tilted. This tilt may be such that the end on the positive side of the Z-direction of the receiving part is narrowed. With such a tilt, the set state of the second water supply tube is stabilized.

(c) The dimensions of the second water supply tube and the clearance C may be decided in such a way that the second water supply tube is not deformed when the second water supply tube is gripped between the receiving part and the action surface in the case where the second water supply tube is not filled with a liquid. Even with such dimensions, the second water supply tube may be deformed when the second water supply tube is gripped between the receiving part and the action surface in the case where the second water supply tube is filled with a liquid.

The Shore A hardness of the second water supply tube may be below 50 or above 80.

The wall thickness of the second water supply tube may be less than 1.65 mm or more than 1.85 mm.

The material of the second water supply tube may be changed. For example, vinyl chloride resin or the like may be employed.

The way of combining the tubes forming the channels from the water supply bag to the handpiece may be changed. For example, the second water supply tube (blockage detection tube) and the pump tube may be formed by a single tube.

The control device may be without the tube pump. For example, the tube pump may be prepared as a separate device.

The action surface may be arranged at a position higher than the upper end of the tube pump or at a position lower than the lower end.

The liquid ejection unit included in the liquid ejection device may be configured to radiate electromagnetic waves to a liquid from an optical maser, laser or the like, or heat the liquid with a heater or the like, so as to eject the liquid.

The blockage detection mechanism may be configured as a device that is independent of the control device.

The blockage detection mechanism may be used for a device (for example, a liquid circulation device) other than the liquid ejection device.

The action surface may be arranged further to the positive side of the Z3-direction than the bolts 751, 752. With this arrangement, a force can be detected with higher sensitivity, using the principle of the lever.

The sensor unit may be without the transmission unit. That is, the sensor unit may be made up of the force sensor only. In this case, an action surface may be provided on the force sensor.

The sensor unit may be fixed directly to the receiving part. Alternatively, the receiving part may be fixed to a first base part, and the sensor unit may be fixed to a second base part. Then, the first base part and the second base part may be fixed together.

The pump for supplying a liquid to the handpiece need not necessarily be the tube pump. For example, a syringe pump may be employed.

The update of the threshold need not necessarily be carried out. That is, the threshold decided with reference to the output value acquired in the case where the liquid has not reached the handpiece (threshold decided in Step S940 in the embodiment) may be continuously used at the time of using the liquid ejection device.

Alternatively, if the liquid has not reached the handpiece, a threshold need not necessarily be decided. That is, only the threshold decided with reference to the output value in the case where the liquid has reached the handpiece (threshold decided in Step S980 in the embodiment) may be decided.

The driving of the tube pump, carried out in order to fill the second water supply tube with a liquid, need not necessarily be controlled with time, unlike in Step S910 in the embodiment. For example, it can be estimated that the second water supply tube is filled with a liquid, by monitoring the output value from the force sensor and detecting that the speed of increase in the output value is increased. Therefore, taking this detection as a cue, the tube pump may be stopped.

The entire disclosure of Japanese Patent Application No. 2016-129705 filed Jun. 30, 2016 is expressly incorporated by reference herein.

What is claimed is:

1. A liquid supply device comprising:

a force sensor which outputs an output value corresponding to a force of expansion of a detection target site of a blockage detection tube communicating with a liquid ejection unit for ejecting a liquid;

a pump for sending out a liquid in the blockage detection tube toward the liquid ejection unit; and a control unit which stops an operation of the pump when the output value reaches a threshold, wherein the control unit decides the threshold, using, as a reference value, the output value acquired when a predetermined condition is satisfied including that the detection target site is filled with the liquid and that the pump is stopped.

2. The liquid supply device according to claim 1, wherein the liquid ejection unit includes a liquid chamber arranged downstream from the blockage detection tube, and the control unit acquires the reference value when a second condition is satisfied including that the liquid chamber is filled with a liquid, in addition to the predetermined condition.

3. The liquid supply device according to claim 2, wherein the liquid election unit includes an ejection tube for ejecting a liquid passed through the liquid chamber, and the control unit acquires the reference value when the liquid has reached a distal end of the election tube, in addition to the second condition.

4. The liquid supply device according to claim 2, wherein the control unit is configured to control driving of a piezoelectric element which changes a capacity of the liquid chamber, and drives the piezoelectric element when the liquid chamber is filled with a liquid, as a part of initial setting processing.

5. The liquid supply device according to claim 1, wherein the control unit drives the pump for a predetermined period in order to fill the detection target site with a liquid, before acquiring the reference value.

6. A liquid ejection device comprising the liquid supply device and the liquid ejection unit according to claim 1.

7. A pump control method in which an operation of a pump for sending out a liquid in a blockage detection tube is stopped when an output value corresponding to a force of expansion of a detection target site of the blockage detection tube, outputted from a force sensor which outputs the output value, is equal to or above a threshold, the method comprising:

deciding the threshold, using, as a reference value, the output value acquired when the detection target site is filled with the liquid and where the pump is stopped.

* * * * *